US009523334B2

(12) United States Patent
Cho et al.

(10) Patent No.: US 9,523,334 B2
(45) Date of Patent: Dec. 20, 2016

(54) SYSTEM AND METHOD OF CONTROLLING FUEL SUPPLY OF DIESEL ENGINE

(71) Applicant: Hyundai Motor Company, Seoul (KR)

(72) Inventors: Cheol Hun Cho, Suwon-Si (KR); Ju Tae Song, Hwaseong-Si (KR)

(73) Assignee: Hyundai Motor Company, Seoul (KR)

( * ) Notice: Subject to any disclaimer, the term of this patent is extended or adjusted under 35 U.S.C. 154(b) by 15 days.

(21) Appl. No.: 14/570,354

(22) Filed: Dec. 15, 2014

(65) Prior Publication Data

US 2015/0252764 A1 Sep. 10, 2015

(30) Foreign Application Priority Data

Mar. 5, 2014 (KR) ..... 10-2014-0025917
Oct. 13, 2014 (KR) ..... 10-2014-0137299

(51) Int. Cl.
*F02M 59/20* (2006.01)
*F02M 69/02* (2006.01)

(52) U.S. Cl.
CPC ..... *F02M 59/20* (2013.01); *F02M 69/02* (2013.01)

(58) Field of Classification Search
CPC ..... F02M 59/20; F02M 59/38; F02M 69/02; F02M 37/08
See application file for complete search history.

(56) References Cited

U.S. PATENT DOCUMENTS 5,313,924 A * 5/1994 Regueiro ..... F02D 41/3836 123/446
8,707,932 B1 * 4/2014 Marin ..... F02D 41/3082 123/479
2005/0178367 A1 * 8/2005 Wolters ..... F02M 37/106 123/514

FOREIGN PATENT DOCUMENTS

| | | | |
|---|---|---|---|
| JP | 08-210209 | A | 8/1996 |
| JP | 10-103125 | A | 4/1998 |
| JP | 2006-329154 | A | 12/2006 |
| JP | 2011-27041 | A | 2/2011 |
| KR | 10-2008-0053796 | A | 6/2008 |
| KR | 10-2011-0062641 | A | 6/2011 |
| KR | 10-1252774 | B1 | 4/2013 |
| KR | 10-2013-0045991 | A | 5/2013 |

* cited by examiner

*Primary Examiner* — Jacob Amick
(74) *Attorney, Agent, or Firm* — Morgan, Lewis & Bockius LLP

(57) ABSTRACT

A system for controlling fuel supply of a diesel engine, may include a fuel pump controller configured to set a fuel supply target pressure supplied from a low-pressure fuel pump to a high-pressure pump in proportion to a quantity of fuel consumed by an injector, and a fuel pressure measurement sensor configured to measure a current fuel supply pressure supplied from the low-pressure fuel pump to the high-pressure pump, wherein revolutions per minute (RPM) of a motor for feeding fuel of the low-pressure fuel pump may be variably adjusted in accordance with the fuel supply target pressure.

6 Claims, 3 Drawing Sheets

SYSTEM AND METHOD OF CONTROLLING FUEL SUPPLY OF DIESEL ENGINE

CROSS-REFERENCE TO RELATED APPLICATION

The present application claims priority to Korean Patent Application Nos. 10-2014-0025917 and 10-2014-0137299 filed on Mar. 5, 2014 and Oct. 13, 2014, respectively, the entire contents of which is incorporated herein for all purposes by this reference.

BACKGROUND OF THE INVENTION

Field of the Invention

The present disclosure relates to a system and a method of controlling fuel supply of a diesel engine. More particularly, it relates to a system and a method of controlling fuel supply of a diesel engine, which set a fuel supply target pressure according to the quantity of fuel consumed by an injector and a temperature of fuel, and adjust revolutions per minute (RPM) for feeding fuel of a low-pressure fuel pump.

Description of Related Art

Most of the fuel injection devices of a diesel vehicle adopt a common rail direct injection system. The common rail direct injection system adopts a method of feeding fuel inside a fuel tank from a low-pressure fuel pump to a high-pressure pump, supplying high-pressure fuel created in the high-pressure pump to a common rail, which is a pressure compression chamber, and injecting high-pressure fuel to an engine by an operation of the injector driven by an electronic automatic device.

The fuel pump mounted in the diesel vehicle includes a low-pressure fuel pump pumping fuel from a fuel tank, and a high-pressure pump pressurizing the fuel pumped by the low-pressure fuel pump at a high pressure.

In order to increase the quantity of fuel injected from the injector in proportion to an RPM of the diesel engine, a discharged pressure of the fuel pump needs to be increased to a predetermined level, and performance of the low-pressure fuel pump demanded by the high-pressure pump is given below.

Performance of low-pressure fuel pump (l/hr)=maximum lubricating and cooling performance of high-pressure pump (l/hr)+maximum fuel consumption quantity of engine (l/hr)

As described above, the low-pressure fuel pump always feeds the maximum quantity of fuel to the high-pressure pump considering overload, a high temperature, and the like, which causes an unnecessary and excessive operation of the low-pressure fuel pump while idling, cruise travelling, and decelerated travelling, which occupy most of the travelling, and thus, power consumption is excessively wasted during the operation of the low-pressure fuel pump, thereby deteriorating fuel efficiency, and excessively generating operational noise of the low-pressure fuel pump.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a system and a method of controlling fuel supply of a diesel engine, which set a fuel supply target pressure according to the quantity of fuel consumed by an injector, and variably adjust an RPM of a low-pressure fuel pump for feeding fuel according to the target pressure, thereby decreasing power consumption of the low-pressure fuel pump to improve fuel efficiency, and decreasing operational noise of the fuel pump.

Another object of the present invention provides a system and a method of controlling fuel supply of a diesel engine, which adjust a fuel supply target pressure to be greater than a current pressure for lubricating and cooling a high-pressure pump when a temperature of fuel is increased according to operational heat of the diesel engine or an increase in a seasonal temperature, thereby increasing an RPM of a low-pressure fuel pump to be greater than a current RPM.

In one aspect, the present invention provides a system for controlling fuel supply of a diesel engine, including a fuel pump controller configured to set a fuel supply target pressure supplied from a low-pressure fuel pump to a high-pressure pump in proportion to the quantity of fuel consumed by an injector, and a fuel pressure measurement sensor configured to measure a current fuel supply pressure supplied from the low pressure fuel pump to the high-pressure pump, in which revolutions per minute (RPM) of a motor for feeding fuel of the low-pressure fuel pump is variably adjusted in accordance with the fuel supply target pressure.

In a preferred embodiment, the system may further include a temperature sensor mounted in a diesel engine and to measure a temperature of the fuel, and an electronic control unit (ECU) configured to receive a measurement value of the temperature sensor and transmit the received measurement value to the fuel pump controller.

In another aspect, the present invention provides a method of controlling fuel supply of a diesel engine, including setting a fuel supply target pressure supplied from a low-pressure fuel pump to a high-pressure pump in proportion to the quantity of fuel consumed by an injector, and variably adjusting revolutions per minute (RPM) of a motor for feeding fuel of the low-pressure fuel pump in accordance with the fuel supply target pressure.

In a preferred embodiment, the method may further include measuring a current fuel supply pressure supplied from the low-pressure fuel pump to the high-pressure pump, comparing the fuel supply target pressure and a current fuel supply pressure, and as a result of the comparison, when the fuel supply target pressure is larger than the current fuel supply pressure, increasing the RPM of the motor, and when the fuel supply target pressure is smaller than the current fuel supply pressure, decreasing the RPM of the motor.

In another preferred embodiment, the method may further include measuring a temperature of fuel injected to the diesel engine, and performing control of increasing an RPM of the low-pressure fuel pump to be larger than a current RPM by adjusting the fuel supply target pressure to be increased when the temperature of the fuel is equal to or higher than a reference temperature.

Through the aforementioned technical solutions, the present invention provides the effects below.

First, it is possible to set a fuel supply target pressure according to the quantity of fuel consumed by the injector of the diesel engine, and variably adjust an RPM of the low-pressure fuel pump for feeding fuel according to the target pressure, so that it is possible to prevent the low-pressure fuel pump from being unnecessarily operated at an excessive RPM even while idling, cruise travelling, and decelerated travelling, thereby decreasing power consumption of the low-pressure fuel pump and improving fuel efficiency.

Second, it is possible to prevent the low-pressure fuel pump from being unnecessarily operated at an excessive RPM, thereby decreasing operational noise of the low-pressure fuel pump.

Third, when a temperature of fuel is increased according to an increase in operational heat or a seasonal temperature of the diesel engine, it is possible to adjust the fuel supply target pressure to be greater than a current pressure to increase the RPM of the low-pressure fuel pump to be greater than a current RPM for lubricating and cooling the high-pressure pump, thereby smoothly lubricating and cooling the high-pressure pump.

Other aspects and exemplary embodiments of the invention are discussed infra.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The above and other features of the invention are discussed infra.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
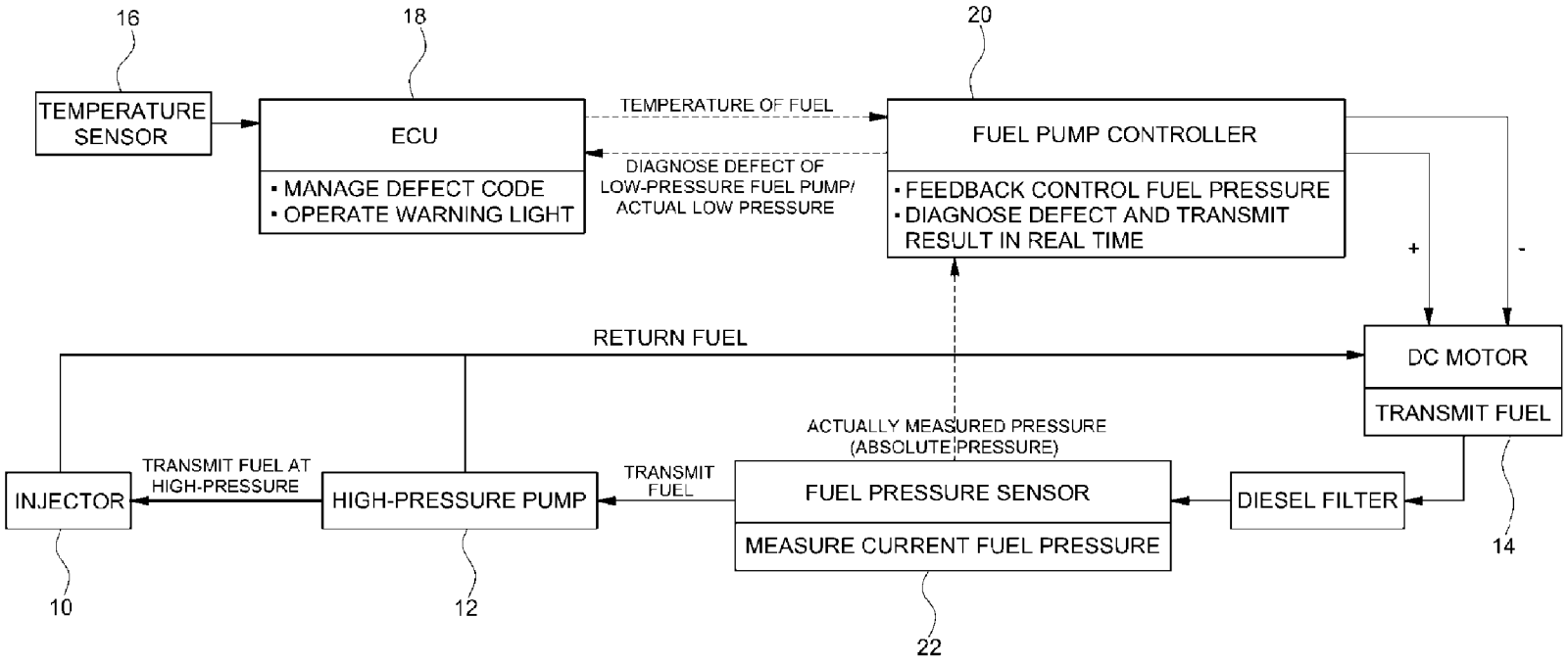
FIG. 1 is a diagram illustrating a system for controlling fuel supply of a diesel engine according to an exemplary embodiment of the present invention.

Reference numerals set forth in the Drawings includes reference to the following elements as further discussed below It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter reference will now be made in detail to various embodiments of the present invention, examples of which are illustrated in the accompanying drawings and described below. While the invention will be described in conjunction with exemplary embodiments, it will be understood that the present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

FIG. 1 is a diagram illustrating a system for controlling fuel supply of a diesel engine according to an exemplary embodiment of the present invention.

As illustrated in FIG. 1, a fuel injection device of a diesel vehicle includes a low-pressure fuel pump 14 for feeding fuel inside a fuel tank to a high-pressure pump 12, the high-pressure pump 12 for creating the fuel from the low-pressure fuel pump 14 to have a high-pressure and supplying the high-pressure fuel to a common rail which is a pressure compression chamber, and an injector 10 for injecting the high-pressure fuel from the high-pressure pump 12 to an engine.

The present invention further includes a fuel pump controller 20 controlling the low-pressure fuel pump 14 to provide a fuel supply system for a diesel engine for supplying the quantity of necessary fuel to the high-pressure pump considering a condition (the quantity of fuel consumed by the injector, and high-pressure pump lubricating/cooling) of an engine.

That is, the present invention focuses the fact that the fuel supply target pressure is changed in accordance with the quantity of fuel consumed by the injector 10 under the control of the fuel pump controller 20, and the low-pressure fuel pump 14 supplies the quantity of fuel demanded by the engine by changing the RPM of the motor in order to follow the fuel supply target pressure, and when a temperature of the fuel of the engine is increased, the quantity of fuel demanded by the engine is increased for lubricating and cooling of the high-pressure pump 12, so that a compensation logic is configured to adjust the fuel supply target pressure to be increased in accordance with an increment of the temperature.

To this end, the present invention includes the fuel pump controller 20 for setting the fuel supply target pressure supplied from the low-pressure fuel pump 14 to the high-pressure pump 12 in proportion to the quantity of fuel consumed by the injector 10, and the fuel pump controller 20 increases or decreases a duty ratio for the RPM of the motor of the low-pressure fuel pump 14 in accordance with the set fuel supply target pressure.

More particularly, the fuel pump controller 20 receives a signal of the quantity of current fuel consumed by the injector 10 and increases or decreases the fuel supply target pressure in proportion to the quantity of fuel consumption to set the increased or decreased fuel supply target pressure, and performs variable control of increasing or decreasing the RPM of the motor for feeding fuel of the low-pressure fuel pump 14 in accordance with the set fuel supply target pressure.

A fuel pressure measurement sensor 22 for measuring a current fuel supply pressure is mounted in a fuel supply line of the fuel supplied from the low-pressure fuel pump 14 to the high-pressure pump 12.

In this case, a signal of the current fuel supply pressure signal detected by the fuel pressure measurement sensor 22 is transmitted to the fuel pump controller 20, and the fuel pump controller 20 determines whether the received current fuel supply pressure follows the fuel supply target pressure, and controls the RPM of the motor in accordance with the fuel supply target pressure.

A temperature sensor 16 measuring a temperature of fuel is mounted in the diesel engine, and when a measurement value of the temperature sensor 16 is transmitted to an ECU 18 of the engine that is the higher controller, the ECU 18 transmits the measurement value of the temperature sensor 16 to the fuel pump controller 20.

For reference, the ECU controls so as to receive a fuel supply pressure feedback control signal, a real-time defect diagnosis signal, and the like from the fuel pump controller, manage a defect code of a fuel supply system, and turn a warning light on when a defect occurs.

Figure 2:
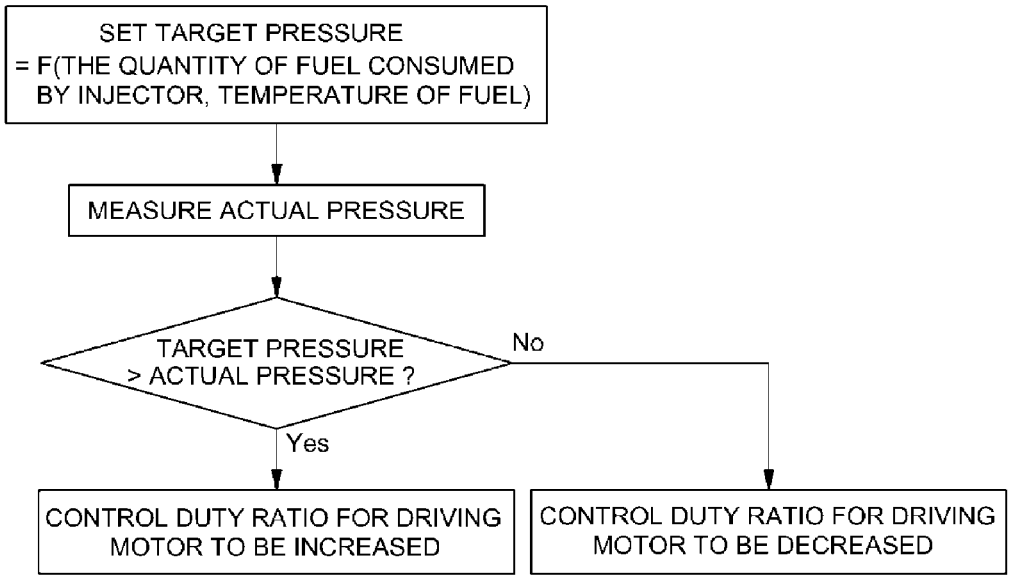
FIG. 2 is a flowchart illustrating a method of controlling fuel supply of a diesel engine according to an exemplary embodiment of the present invention.

Here, a method of controlling fuel supply of the present invention based on the aforementioned configuration will be described below with reference to accompanying FIGS. 1 to 3.

First, an operation of setting a fuel supply target pressure supplied from the low-pressure fuel pump to the high-pressure pump in proportion to the quantity of fuel consumed by the injector is performed.

That is, when the fuel pump controller 20 receives a signal of the quantity of current fuel consumed by the injector 10, the fuel pump controller 20 increases or decreases the fuel supply target pressure in proportion to the quantity of fuel consumed by the injector to set the increased or decreased fuel supply target pressure.

Figure 3:
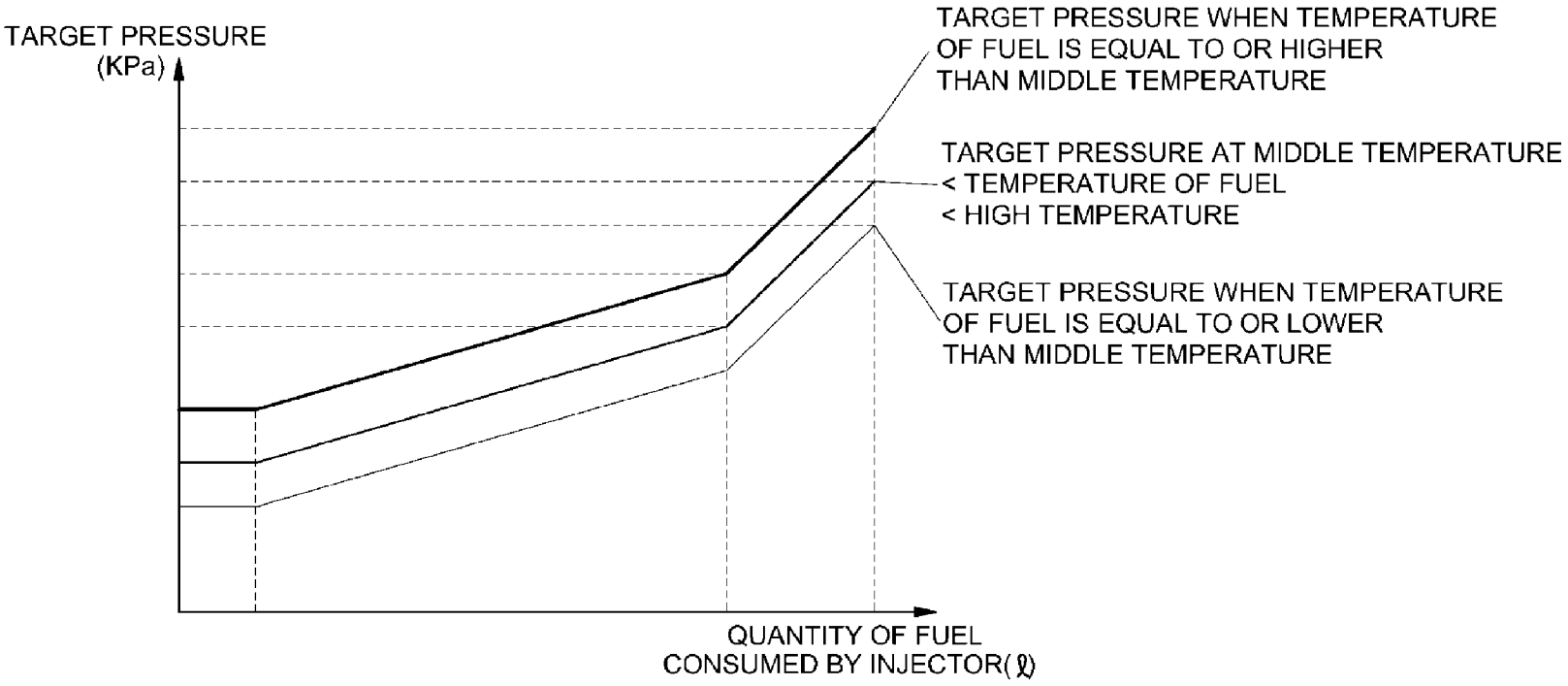
FIG. 3 is a graph illustrating an example of setting a fuel supply target pressure according to the quantity of fuel consumed by an injector and a temperature of fuel while controlling fuel supply of the diesel engine according to an exemplary embodiment of the present invention.

For example, as can be seen in the graph of FIG. 3, when the quantity of fuel consumed by the injector is large like high-speed travelling or accelerated travelling, the fuel pump controller 20 increases the fuel supply target pressure to set the increased fuel supply target pressure, but when the quantity of fuel consumed by the injector is small during the idling, cruise travelling, and decelerated traveling, the fuel pump controller 20 decreases the fuel supply target pressure to set the decreased fuel supply target pressure.

Next, the fuel pump controller 20 performs duty ratio variation control of increasing or decreasing the RPM of the motor for feeding fuel of the low-pressure fuel pump 14 in accordance with the set fuel supply target pressure.

That is, when the quantity of fuel consumed by the injector is increased and the fuel supply target pressure is increased at the time of the high-speed travelling or the accelerated traveling, the fuel pump controller 20 performs duty ratio variation control of increasing the RPM of the motor for feeding fuel of the low-pressure fuel pump 14, but when the quantity of fuel consumed by the injector is decreased and the fuel supply target pressure is decreased at the time of idling, cruise travelling or decelerated traveling, the fuel pump controller 20 performs duty ratio variation control of decreasing the RPM of the motor for feeding fuel of the low-pressure fuel pump 14.

Accordingly, it is possible to prevent the low-pressure fuel pump from being unnecessarily operated at an excessive RPM even during idling, cruise travelling or decelerated traveling, and thus decrease power consumption of the low-pressure fuel pump, thereby improving fuel efficiency.

In the meantime, due to resistance loss of the fuel generated in a line connecting the low-pressure fuel pump and the high-pressure pump, and the like, an actual fuel pressure, that is, a current fuel supply pressure, heading from the low-pressure fuel pump to the high-pressure pump, may be lower than the fuel supply target pressure.

In this case, when a signal of the current fuel supply pressure detected by the fuel pressure measurement sensor 22 is transmitted to the fuel pump controller 20, the fuel pump controller 20 compares the current fuel supply pressure and the fuel supply target pressure, and controls the RPM of the motor in accordance with the fuel supply target pressure.

More particularly, as a result of the comparison of the current fuel supply pressure and the fuel supply target pressure by the fuel pump controller 20, when the fuel supply target pressure is greater than the current fuel supply pressure, the fuel pump controller 20 controls so as to increase the RPM of the motor in order to increase the current fuel supply pressure to the fuel supply target pressure, but when the fuel supply target pressure is lower than the current fuel supply pressure, the fuel pump controller 20 controls so as to decrease the RPM of the motor in order to decrease the current fuel supply pressure to the fuel supply target pressure, so that the fuel supply target pressure may always be maintained at a set level.

As the exemplary embodiment of the present invention, when the fuel is supplied to the high-pressure pump in accordance with the fuel supply target pressure to be injected through the injector, an operation of measuring a temperature of fuel by the temperature sensor is performed, and the measured temperature sensing value is transmitted to the fuel pump controller 20.

When the temperature of fuel is increased according to an increase in operational heat of the diesel engine or the seasonal temperature, lubricating and cooling for the high-pressure pump are required.

Accordingly, when the fuel pump controller 20 determines that lubricating and cooling of the high-pressure pump according to an increase in the temperature of the fuel are required based on the temperature sensing value measured by the temperature sensor 16, the fuel pump controller 20 controls so as to adjust the fuel supply target pressure to be greater than the current pressure, and increase the RPM of the low-pressure fuel pump to be greater than a current RPM.

For example, as can be seen in the graph of FIG. 3, when the temperature of the fuel is equal to or higher than a high temperature (about 60° C.), the fuel pump controller 20 adjusts the fuel supply target pressure to be increased, and when the temperature of the fuel is equal to or lower than a middle temperature, the fuel pump controller 20 adjusts the fuel supply target pressure to be decreased.

Next, compensation of increasing the quantity of fuel in a low temperature state supplied from the low-pressure fuel pump to the high-pressure pump is performed under the control of increasing the RPM of the low-pressure fuel pump to be greater than the current RPM, so that it is possible to smoothly lubricate and cool the high-pressure pump.

In the meantime, when the high-pressure pump is in a high temperature state in which the high-pressure pump rapidly demands lubricating and cooling, the fuel within the fuel tank is a low fuel state, or the vehicle is in a rapid acceleration state in which fuel consumption is rapidly increased during the process of controlling the fuel supply pressure for the high-pressure pump and the engine to have a predetermined level by adjusting the RPM for feeding fuel by the low-pressure fuel pump, a fuel supply flow to the high pressure pump may be insufficient, and as a result, the high-pressure pump may be broken due to insufficient lubricating and cooling, and the vehicle may be stalled during travelling.

Accordingly, when the high-pressure pump is in the high temperature state in which the high-pressure pump rapidly demands lubricating and cooling, the fuel within the fuel tank is the low fuel state, or the vehicle is in the rapid acceleration state in which fuel consumption is rapidly increased, the process of controlling the fuel supply pressure for the high-pressure pump and the engine to have the predetermined level by adjusting the RPM for feeding fuel by the low-pressure fuel pump is stopped, and the compensation logic of protecting the high-pressure pump and maximizing the fuel supply flow is executed.

The compensation logic includes: a fuel temperature compensation operation of maximally supplying the fuel to the high-pressure pump by driving 100% the low pressure fuel pump when the high-pressure pump is in the high temperature state in which the high-pressure pump rapidly demands lubricating and cooling, a low fuel compensation operation of maximally supplying the fuel to the high-pressure pump by driving 100% the low pressure fuel pump when a fuel warning light is turned on and it is confirmed that the fuel is in the low fuel state, and a rapid acceleration compensation operation of maximally supplying fuel to the high-pressure pump by driving 100% the low-pressure fuel pump when the fuel supplied to the high-pressure pump is momentarily short due to the rapid increase in fuel consumption during rapid acceleration.

In this case, when the aforementioned compensation logic is not executed, that is, when the fuel is not sufficiently supplied to the high-pressure pump, a failure diagnosis logic of turning on an engine warning light is executed in order to protect the high-pressure pump.

Here, each operation of the compensation logic will be described in more detail below.

Fuel Temperature Compensation Operation

The fuel temperature compensation operation is performed in the case where the high-pressure pump is in the high temperature state in which the high-pressure pump rapidly demands lubricating and cooling during the process of controlling the fuel supply pressure for the high-pressure pump and the engine to have the predetermined level by adjusting the RPM for feeding fuel by the low-pressure fuel pump as described above (for example, when the fuel supply pressure is adjusted to be dropped).

For example, as can be seen in Table 1 below, the fuel temperature compensation operation is performed when the high-pressure pump requires rapid lubricating and cooling, such as the case where the temperatures of the high-pressure pump and the fuel supplied to the high-pressure pump are rapidly increased to a reference temperature or higher due to operation heat of the diesel engine or an increase in a seasonal temperature, or the case where an outdoor temperature is increased to a reference temperature or higher.

TABLE 1

| | Fuel temperautre comepnsation logic entrance condition | Fuel temperautre comepnsation logic release condition | Contents |
|---|---|---|---|
| High temperature condition | Fuel temperature (reference temperature ↑) or outdoor temperature ((reference temperature ↑) | Fuel temperature (reference temperature ↓) or outdoor temperature ((reference temperature ↓) | No perform fuel supply pressure control during travelling (drive 100% the pump motor) |
| Low temperature condition | Diesel filter heater sensor ON (fuel temperature reference temperature ↓) | Diesel filter heater sensor OFF (fuel temperature reference temperature ↑) | When the diesel filter heater sensor is on, not perform fuel supply pressure control (drive 100% the pump motor) |

To this end, when the high-pressure pump is in the high temperature state in which the high-pressure pump rapidly demands lubricating and cooling, the process of controlling the fuel supply pressure for the high-pressure pump and the engine to have the predetermined level by adjusting the RPM for feeding fuel by the low-pressure fuel pump as described above is stopped, and the fuel in the low-temperature state is maximally supplied to the high-pressure pump by driving 100% the low-pressure fuel pump, so that it is possible to rapidly lubricate and cool the high-pressure pump.

In this case, even in a cold start condition in which temperatures of the high-pressure pump and the fuel left in the high-pressure pump are the reference temperature or lower, the process of controlling the fuel supply pressure for the high-pressure pump and the engine to have the predetermined level by adjusting the RPM for feeding fuel by the low-pressure fuel pump as described above is stopped, and the pre-heated fuel by the diesel filter heater is maximally supplied to the high-pressure pump by driving 100% the low-pressure fuel pump while simultaneously confirming that the heater sensor is on according to an operation of the diesel filter heater, so that it is possible to smoothly perform the cold start by rapidly increasing a temperature of the fuel supplied to the high-pressure pump during the cold start.

Low Fuel Compensation Operation

When the vehicle rapidly turns or rapidly decelerates in the low fuel state, that is, in the state where the fuel warning light is turned on, the fuel consumption demanded by the engine is increased so that the amount of fuel supplied to the high-pressure pump needs to be increased. However, when the process of controlling the fuel supply pressure for the high-pressure pump and the engine by adjusting the RPM for feeding fuel by the low-pressure fuel pump as described above is performed (for example, when the fuel supply pressure is adjusted to be dropped), the fuel supply flow may be insufficient due to the drop of the fuel supply pressure for the high-pressure pump, and as a result, the high-pressure pump may be damaged due to insufficient lubricating and cooling.

Accordingly, in the low fuel state, that is, in the state where the fuel warning light is turned on, the process of controlling the fuel supply pressure for the high-pressure pump and the engine by adjusting the RPM for feeding fuel by the low-pressure fuel pump as described above is stopped, and the low fuel compensation operation of maximally supplying the fuel to the high-pressure pump by driving 100% the low pressure fuel pump is performed, so that it is possible to sufficiently supply the fuel supply flow to the high-pressure pump, and thus it is possible to prevent the high-pressure pump from being damaged due to insufficient lubricating and cooling.

In this case, when the fuel warning light is turned off or the start is off, the low fuel compensation logic is released.

Rapid Acceleration Compensation Operation

When the vehicle rapidly accelerates during travelling, the fuel consumption demanded by the engine is increased so that the amount of fuel supplied to the high-pressure pump needs to be increased. However, when the process of controlling the fuel supply pressure for the high-pressure pump and the engine by adjusting the RPM for feeding fuel by the low-pressure fuel pump as described above is performed as described above (for example, when the fuel supply pressure is adjusted to be dropped), the fuel supply flow may be insufficient due to the drop of the fuel supply pressure for the high-pressure pump, and as a result, the high-pressure pump may be damaged due to insufficient lubricating and cooling.

Accordingly, when the vehicle rapidly accelerates, the process of controlling the fuel supply pressure for the high-pressure pump and the engine by adjusting the RPM for feeding fuel by the low-pressure fuel pump as described above is stopped, and the rapid acceleration compensation operation of maximally supplying the fuel to the high-pressure pump by driving 100% the low pressure fuel pump is performed, so that it is possible to sufficiently supply the fuel supply flow to the high-pressure pump, and thus it is possible to prevent the high-pressure pump from being damaged due to insufficient lubricating and cooling.

Failure Diagnosis Logic

When the compensation logic including the fuel temperature compensation operation, the low fuel compensation operation, and the rapid acceleration compensation operation is not executed, that is, the fuel is not sufficiently supplied to the high-pressure pump, an engine warning light turn-on operation of determining that the low-pressure fuel pump has a problem, and for protecting the high-pressure pump is executed.

For example, when an actually measured pressure of the low-pressure fuel pump is equal to or smaller than a reference pressure for a predetermined time (several seconds or more), it is determined that the low-pressure fuel pump has a problem, and the engine warning light of the cluster of the front surface of the driver's seat is turned on, thereby inducing a repair of the low-pressure fuel pump for protecting the high-pressure pump.

As described above, even when the high-pressure pump is in the high temperature state in which the high-pressure pump rapidly demands lubricating and cooling, the fuel within the fuel tank is the low fuel state, or the vehicle is in the rapid acceleration state in which fuel consumption is rapidly increased during the process of controlling the fuel supply pressure of the high-pressure pump and the engine to have a predetermined level by adjusting the RPM for feeding fuel by the low-pressure fuel pump as described above, it is possible to sufficiently secure the fuel supply flow for the high-pressure pump, thereby easily preventing the damage of the high-pressure pump caused by insufficient lubricating and cooling and the start from being stalled during travelling.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A system for controlling fuel supply of a diesel engine, comprising:

a fuel pump controller configured to set a fuel supply target pressure supplied from a low-pressure fuel pump to a high-pressure pump in proportion to a quantity of fuel consumed by an injector; and a fuel pressure measurement sensor configured to measure a current fuel supply pressure supplied from the low-pressure fuel pump to the high-pressure pump, wherein revolutions per minute (RPM) of a motor for feeding fuel of the low-pressure fuel pump is variably adjusted in accordance with the fuel supply target pressure, wherein the fuel pump controller compensates for fuel temperature by maximally supplying fuel to the high-pressure pump by driving 100% the low-pressure fuel pump when the high-pressure pump is in a high temperature state in which the high-pressure pump demands lubricating and cooling faster than a predetermined rate, compensates for low fuel by maximally supplying fuel to the high-pressure pump by driving 100% the low pressure fuel pump when a fuel warning light is turned on and the fuel is less than a predetermined amount, and compensates for rapid acceleration of a vehicle by maximally supplying fuel to the high-pressure pump by driving 100% the low-pressure fuel pump when fuel consumption is increased faster than a predetermined rate during the rapid acceleration and the fuel supplied to the high-pressure pump is less than a predetermined amount for a predetermined time, wherein the rapid acceleration is an acceleration higher than a predetermined rate.

2. The system of claim 1, further comprising:

a temperature sensor mounted in the diesel engine to measure a temperature of the fuel; and an electronic control unit (ECU) configured to receive a measurement value of the temperature sensor and transmit a received measurement value to the fuel pump controller.

3. A method of controlling fuel supply of a diesel engine, comprising:

setting a fuel supply target pressure supplied from a low-pressure fuel pump to a high-pressure pump in proportion to a quantity of fuel consumed by an injector;

variably adjusting revolutions per minute (RPM) of a motor for feeding fuel of the low-pressure fuel pump in accordance with the fuel supply target pressure;

compensating for fuel temperature by maximally supplying fuel to the high-pressure pump by driving 100% the low-pressure fuel pump when the high-pressure pump is in a high temperature state in which the high-pressure pump demands lubricating and cooling faster than a predetermined rate;

compensating for low fuel by maximally supplying fuel to the high-pressure pump by driving 100% the low pressure fuel pump when a fuel warning light is turned on and the fuel is less than a predetermined amount; and compensating for rapid acceleration of a vehicle by maximally supplying fuel to the high-pressure pump by driving 100% the low-pressure fuel pump when fuel consumption is increased faster than a predetermined rate during rapid acceleration and the fuel supplied to the high-pressure pump is less than a predetermined amount for a predetermined time, wherein the rapid acceleration is an acceleration higher than a predetermined rate.

4. The method of claim 3, further comprising:

measuring a current fuel supply pressure supplied from the low-pressure fuel pump to the high-pressure pump;

comparing the fuel supply target pressure and the current fuel supply pressure; and as a result of the comparison, when the fuel supply target pressure is greater than the current fuel supply pressure, increasing the RPM of the motor, and when the fuel supply target pressure is lower than the current fuel supply pressure, decreasing the RPM of the motor.

5. The method of claim 3, further comprising:

measuring a temperature of fuel injected to the diesel engine; and performing control of increasing an RPM of the low-pressure fuel pump to be greater than a current RPM by adjusting the fuel supply target pressure to be increased when the temperature of the fuel is equal to or higher than a reference temperature.

6. The method of claim 3, further comprising:

when the compensating of the fuel temperature, the compensating of the low fuel, and the compensating of the rapid acceleration are not executed, determining that the low-pressure fuel pump has a problem and turning on an engine warning light for protecting the high-pressure pump.

* * * * *